United States Patent [19]

Ferrera et al.

[11] 4,151,803

[45] May 1, 1979

[54] KNOCK DOWN CORRUGATED BOARD FLOOR DISPLAY

[75] Inventors: Joseph P. Ferrera, Montville, N.J.; Kenneth W. Valero, Nantucket, Mass.

[73] Assignee: Merchandising Display Corporation, Englewood, N.J.

[21] Appl. No.: 902,995

[22] Filed: May 5, 1978

[51] Int. Cl.[2] ..... A47B 43/02

[52] U.S. Cl. ..... 108/41; 108/111; 248/174; 211/135

[58] Field of Search ..... 108/111, 115, 41; 248/174; 211/149, 195, 135, 150; 24/128 R

[56] References Cited

U.S. PATENT DOCUMENTS

| | | | |
|---|---|---|---|
| 915,618 | 3/1909 | Mattison | 211/149 X |
| 1,602,410 | 10/1926 | Hamblin | 108/111 |
| 1,902,566 | 3/1933 | Marsh | 248/174 X |
| 2,180,131 | 11/1939 | Zinser | 211/135 X |
| 2,724,881 | 11/1955 | Di Maria | 24/128 R |
| 3,139,192 | 6/1964 | Maguire | 211/149 X |
| 3,508,734 | 4/1970 | Thomas | 248/174 X |
| 3,549,019 | 12/1970 | Wood et al. | 211/135 |
| 3,863,575 | 2/1975 | Kuns | 108/111 |
| 3,987,737 | 10/1976 | Smith | 108/111 |

*Primary Examiner*—Roy D. Frazier
*Assistant Examiner*—Peter A. Aschenbrenner
*Attorney, Agent, or Firm*—Fidelman, Wolffe & Waldron

[57] ABSTRACT

The knock down corrugated board floor display illustrated in FIG. 2 with shelves and side walls pivotally secured to a rear wall, and side wall attached ropes supporting the shelves in the display erected position. Corner panels on the side walls pivot partially inward upon collapse of the display and the balance of the side walls pivot fully to lie parallel to rear wall, sandwiching the shelves and ropes between side walls and rear wall, the corner panels becoming the sides of the reasonably flat box-like structure into which the display collapses.

The display is formed from relatively thin corrugated board panels, which panels are doubled over in creation of side walls and shelves for esthetic and structural purposes, with reinforcement pieces of corrugated board being sandwiched inside the doubled over panels wherever structural reinforcement is desirable.

10 Claims, 7 Drawing Figures

KNOCK DOWN CORRUGATED BOARD FLOOR DISPLAY

INTRODUCTION

This invention relates to display structures of the collapsible or knockdown type formed from corrugated board.

Temporary display structures capable of conversion almost instantly from a flat collapsed condition into a usable multiple shelf display device are of considerable value in drug stores, supermarkets, department stores etc. notably for display and merchandising of advertised specials. Such displays (including the display of this invention) often are formed of corrugated board, the well known composite of a fluted or corrugated paper layer overlaid or faced by even sheets of (high grade) paper.

RATIONALE OF THIS INVENTION

The widespread use of corrugated board for packaging purposes has made available a multitude of weight and strength corrugates (including corrugated boards made in whole or in part from materials other than paper); the user has a wide choice. Specifically the corrugated board comes in various fluting such as for example a B-flute, and strengths e.g. 200 lb test and with one or both sides ornamented, e.g. one side white or lithographed. Suffice it to point out that attractively ornamented display structures can and are formed from standard corrugated boards strong enough to bear heavy loads (i.e. of merchandise) on the shelves of the display device.

However, the cost of the display does, of course, depend upon the expenses of the corrugated board and of fabricating the display therefrom. Highly advantageous for a corrugated board display structure are: avoidance of complexity in the components, unnecessarily strong components, and significant proportions of scrap or wastage. The structure of this invention uses the corrugated board efficiently, and well.

An attribute of corrugated board significant to the structure of this invention is that corrugated board bends readily, particularly when the bend line extends longitudinally of the corrugations therein. When stood on an edge transverse to the corrugations, corrugated board is relatively stiff and strong, fully capable of bearing a substantial load.

Characteristically temporary display devices are of limited life and must be inexpensive. Efficient use of corrugated board and low fabrication costs are essential. Desirably the display device will be a disposable item, inexpensive enough for one-time use as part of a sales promotion, (for the merchandise being displayed). The structures of this invention can be fabricated readily and waste little or none of the corrugated board.

STRUCTURE OF THIS INVENTION

For detailed understanding of the present invention reference is now made to the drawing wherein:

FIG. 1 diagrammatically illustrates the display device in knocked down state;

FIG. 2 diagrammatically illustrates the display device in a partially collapsed state;

FIG. 3 diagrammatically illustrates the display device fully open ready for use;

Figure 3:
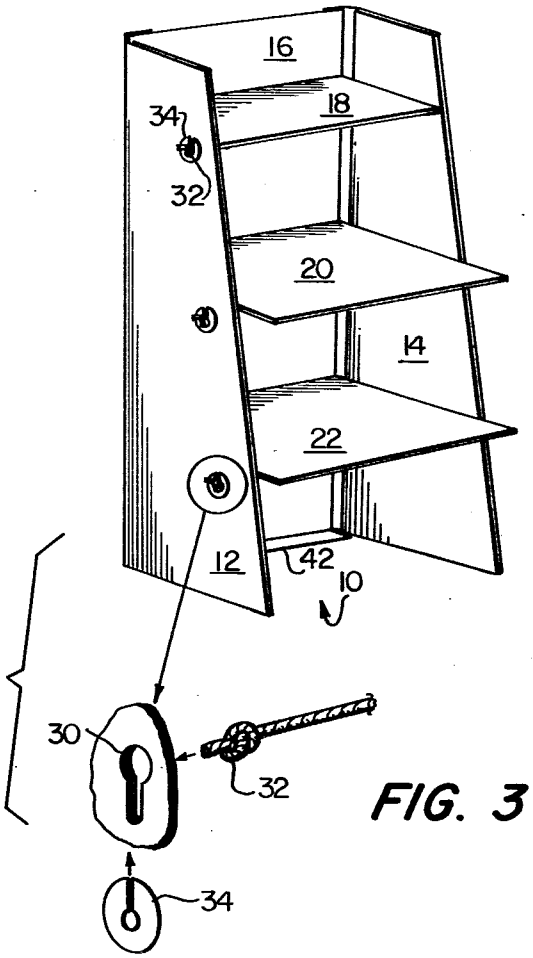
Figure 2:
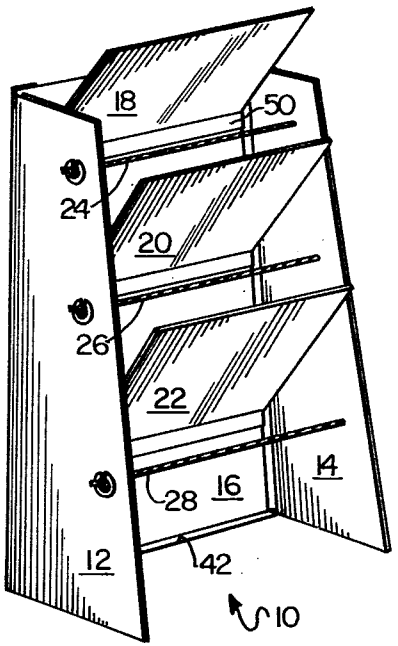
Figure 1:
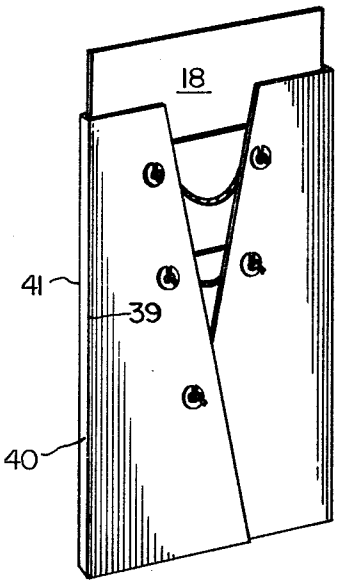

Referring now to FIGS. 1, 2, 3 it may be seen that the display device 10 is shaped as an upstanding squared off channel with a pair of opposed vertical side walls 12, 14 extending forward of a vertical back or rear wall 16. Shelves extend horizontally back to front inside of the side walls, three 18, 20, 22 being illustrated. The shelves 18, 20, 22 are hingedly attached to the front face of back wall 16 and, when extended to their horizontal attitude are supported by ropes 24, 26, 28, It may be noted that when display 10 is opened from the knocked down state illustrated in FIG. 1 and the shelves swing downwardly as is shown in FIG. 2, the lower shelves 20 and 22 swing clear of the upper shelf support ropes 24 and 26 respectively. While the length of the shelves is a matter of choice, shelves 20, 22 being illustrated as equal in length and shelf 18 being illustrated as a shorter shelf, a desirable relationship is for the length of lower shelves 20, 22 to be greater than the distance between shelves. As shown in FIG. 1 top shelf 18 may extend above the top edge of side walls 12, 14 and of back wall 16 when display device 10 is in the knockdown position.

Each of the rope supports, e.g. rope 24, is knotted to size then inserted through a keyhole slot 30 of which there is one on each side wall 12, 14, for each rope. For purposes of distributing the forces exerted by the knot, e.g. knot 32, against the corrugated board periphery of keyhole slot 30 a split (plastic) washer 34 is interposed (on rope 24) between knot 32 and keyhole slot 30. The length of rope left between the knots is predetermined so that each rope, e.g. rope 24, is placed under a moderate degree of tension when display 10 is in the fully open position illustrated by FIG. 3, thereby forcing side walls 12, 14 into (some degree of friction grip) contact with the shelf side edges, e.g. shelf 18 in the instance of rope 24. The location, front to rear, of the shelf for its rope support is a matter of choice, but to minimize creation of unnecessarily large stresses on the shelf by placement of merchandise thereon, the rope support should be mounted reasonably near the front edge of the side walls 12, 14 and such is illustrated in the drawing.

However, the display device 10 is not so fragile as to preclude esthetic variations. Thus the front edge of side 12, 14 may be angled (see FIG. 1). Also, as is illustrated in the drawing for shelf 20, one or more shelves may overhang their rope supports significantly.

One attribute of corrugated board is its resiliency. Merchandise of any weight placed on the shelf will make the corrugated board deform under the load enough to conform (more or less) to the length of its underlying rope support. Choice of a rope length such that the rope is under a moderate degree of tension when its shelf is down (i.e. horizontal) straightens the rope out into an essentially horizontal support member capable of being loaded along its entire length. Yet the ropes become completely flaccid when the shelves are raised and side walls 12, 14 bend inwardly, allowing display 10 to collapse into its knock down position (of FIG. 1).

When display 10 is collapsed to the knockdown position side walls 12 and 14 fold one over the other, e.g. 12 over 14, as is illustrated in FIG. 1 with shelves 18, 20, 22 and ropes 24, 26, 28 sandwiched between the side walls 12, 14 and the back wall 16. Provision of a double bend at bend lines 39 and 41 at the rear of each sidewall creates a narrow corner panel 40 which becomes the entire side wall when display device 10 is knocked down. Panel 40 is deep enough to accommodate the space needs of the (folded up) shelves and ropes sandwiched between side walls 12, 14, and back wall 16. A bottom panel 42 comparable in width to corner panel 40 is formed by bending forward a bottom flap on back wall 16.

Figure 6:
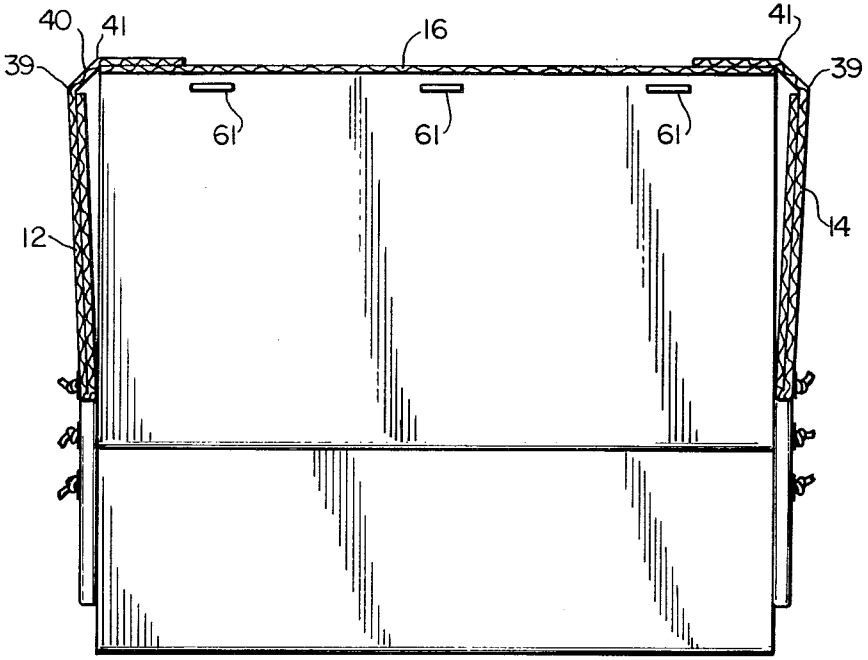
FIG. 6 is a top view of the device.

Manifestly the display device 10 is best protected against mishandling when either fully erected or fully collapsed, and is somewhat vulnerable when partially collapsed, (as is illustrated in FIG. 2). In the mode of display device illustrated herein shelf spacing and shelf length are selected to avoid mishandling during erection or collapse of display device 10. As is shown in FIG. 6 of the drawing, presence of spaced apart bend lines 39 and 41 with corner panel 40 therebetween at the rear of each side wall creates a geometric relationship such that the rear side edges of the shelves clear side walls 12, 14. Therefore, when the knocked down display device 10 is stood up vertically, as in FIG. 1, and side walls 12, 14 are unfolded as in FIG. 2 the shelves pivot forward (from their own weight) until the lateral sides of the shelves scrape against the side wall surfaces and come to rest (due to a friction grip between shelves and side walls), at, for example, the angle illustrated on FIG. 2 for shelves 20 and 22. In this partially open position the display device 10 is stable and self supporting. Ropes 24, 26 and 28 are mildly tensioned and the person erecting the display device 10 no longer needs to hold the display device 10. His or her hands are freed to lower the shelves to their open horizontal position.

Upon collapse of the display device a reverse situation exists, but in practice it is easier to flip the display on its back; whereupon it almost self collapses. Desirably the length of shelf 22 is greater than the spacing betwen shelves 20, 22 and the length of shelf 20 is greater than the distance between shelves 18, 20, Pushing shelf 22 up will cause the forward edge of shelf 22 to touch, then to push shelf 20 up and in turn the forward edge of shelf 20 pushes shelf 18 up. In the knockdown position some shelf to shelf overlap exists, and the width of corner panel 40 corresponds to the thickness of two shelves.

As can be seen from the foregoing description and by the drawings, the display device of this invention is an attractive functional display that can be shipped and stored in (a thin) fully collapsed condition, then erected by doing no more than extending sides 12, 14 to their open position and flipping shelves 18, 20, 22 into their horizontally extended position. Thus, to repeat, the display device of this invention packages well, sets up readily and is functionally attractive.

Not so clearly apparent is that the display device of this invention is readily fabricated and efficiently utilizes the corrugated board from which it is fabricated.

Figure 5:
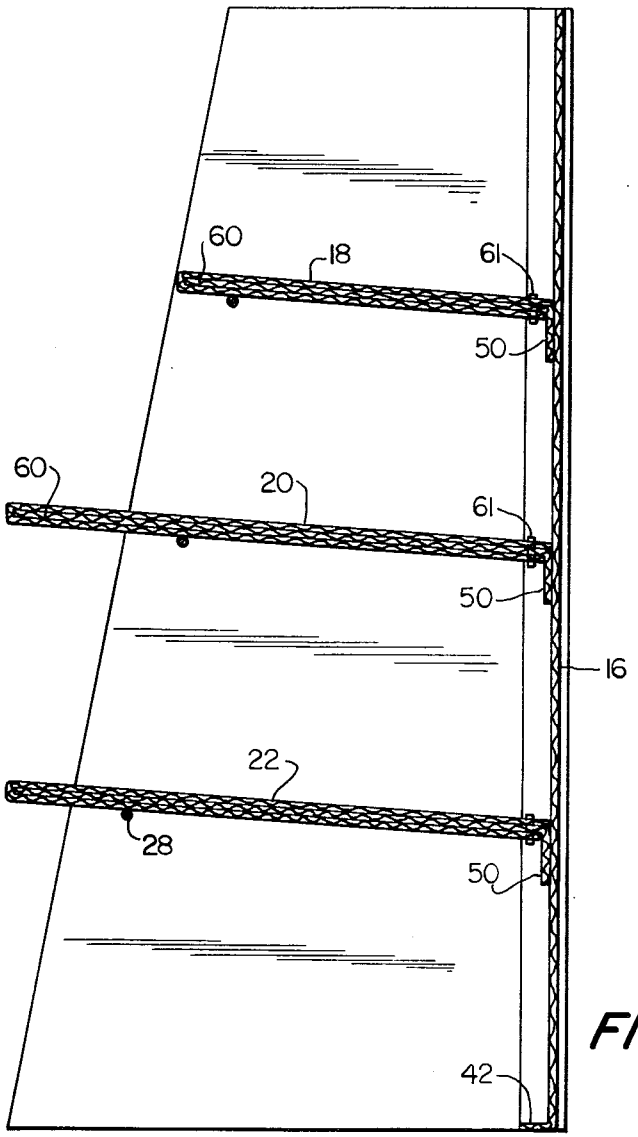
FIG. 5 is a side section of the device.
Figure 4:
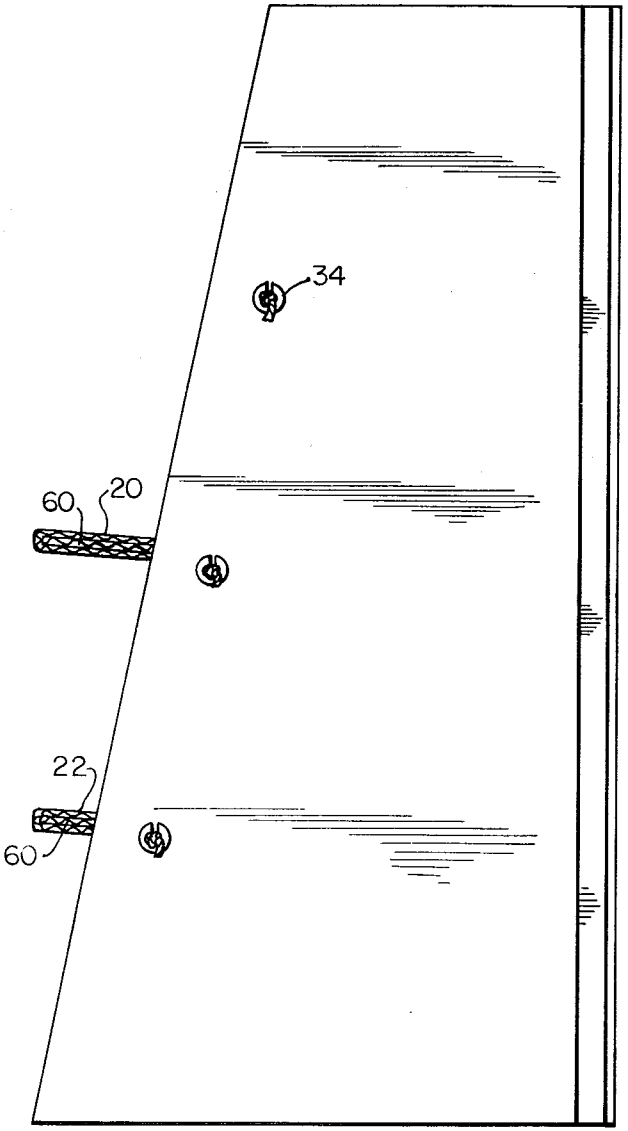
FIG. 4 is a side view of the device.

Referring now to the side section view of FIG. 5 and the (from the) top view of FIG. 6, it may be noted how back 16 has been formed from a single rectalinear panel (e.g. 48"×36") whose corrugations extend vertically. A (transverse) bend near the lower edge forms the bottom flap 42 which together with corner panels 40, very nearly turns the knocked down display device into its own box.

With the corrugations in the panel of back wall 16 vertical, the panel is positioned so that its greatest load strength (and weight carrying ability) is in the direction which best supports the merchandise on display device 10. In addition a significant reinforcement to the back wall 16 is provided by the expedient of overlapping the panel from which back wall 16 is formed by the panels from which the side walls 12 and 14 have been formed (as is shown in FIG. 6). The overlapped portions are glued to the rear face of back wall 16.

The sides 12, 14 are also formed from rectalinear panels. (However, in order to create the angled front edges of side 12 and of side 14, the corrugated board web from which each side well panel is taken must be cut on an appropriate bias). In the mode illustrated herein, the panel from which a side wall 12, or 14 is formed is doubled back on itself against the inside surface (as shown in FIG. 6) as far as bend line 39 to give double strength, double thickness corrugated board for side walls 12 and 14. It may be noted however that the more flexible single thickness of corrugated board is employed for corner panel 40 and for the overlap on back wall 16. As in the instance of back 16, the sides 12, 14 are disposed with the corrugations extending vertically, so that the greatest strength of the panel is in the load direction supportive of the merchandise on the shelves.

It is noteworthy that the bends 41 and 39, both of which constitute hinge joints, bend but a single thickness of corrugated board, bend 41 being at the junction of the back wall 16 with the single thickness of side panel corrugated board and bend 39 being made at the terminus edge line of the internally doubled back corrugated board panel from which the side wall is formed.

Each of the shelves 18, 20, 22 also are formed from rectalinear panels of corrugated board. A single thickness of board rear flap 50 is bent down and its face glued to back wall 16 (shown in FIGS. 2 and 5) to form the hinged attachment of shelf to the rear wall. At the front edge of each shelf the corrugated board is doubled under, the doubled thickness terminating just short of rear flap 50. The doubled portions may of course by glued together, but in the instance of the shelves stapling the layers together by staples 61 suffices. The corrugations inside the shelves extend front to rear.

Employment of doubled thicknesses of corrugated board for the side walls 12, 14 and shelves 18, 20, 22 have esthetic advantages. A single thickness of corrugated board for shelf and/or side wall necessarily would exposes the view a panel edge (i.e. the corrugated material inside the corrugated board) whereas doubling over of corrugated board panels for side walls 12, 14 and for shelves 18, 20, 22 places the (often attractive) face side sheet of the corrugated board panel on the front edge surfaces thereof as can best be seen in FIGS. 5, 6 and 7.

Thus the entire display device can be found from a single grade, thickness etc. of relatively thin corrugated board e.g. white face B-flute 200 lb. test. Where reinforcement is not required, as on most of back wall 16, single thickness of corrugated board may be employed. Where little reinforcement is desired e.g. for back wall 16, such is provided by use thereon of an overlap layer of material from the panels formed into side walls 12, 14. The rigidity of rear wall 16 is, of course, increased by presence of the laterally extending flaps 50 glued thereto.

Moreover the doubling over construction feature employed for shelves and side walls facilitates inclusion of any additional reinforcement material where needed in display device 10 as for example in the lower portions of side walls 12, 14. In the usual instance where more or less equal weight of merchandise is placed on each shelf, only the weight of merchandise on shelf 18 is supported by those portions of side walls 12, 14 and back wall 16 disposed between shelves 18 and 20. The weight of merchandise on shelf 20 is added to the load (already present from shelf 18) on those portions of side walls 12, 14 and back wall 16 disposed between shelves 20 and 22. In turn the weight of merchandise on shelf 22 adds to the load on those portions of side walls 12, 14 and back wall 16 disposed beneath shelf 22. Manifestly, the total weight carried by the bottom of sides 12, 14 and of back 16 might well exceed the load carrying capability of the corrugated board requiring reinforcement for the side walls. However, reinforcement of side walls 12, 14 of display device 10 so as to be certain that the weight of merchandise on shelves 18, 20, 22 does not collapse the display device is not needed at locations above shelf 20, and perhaps not even above shelf 22. (Of course if not needed below shelf 22, reinforcement is not needed at all).

A like need for reinforcement of the shelves may exist.

Figure 7:
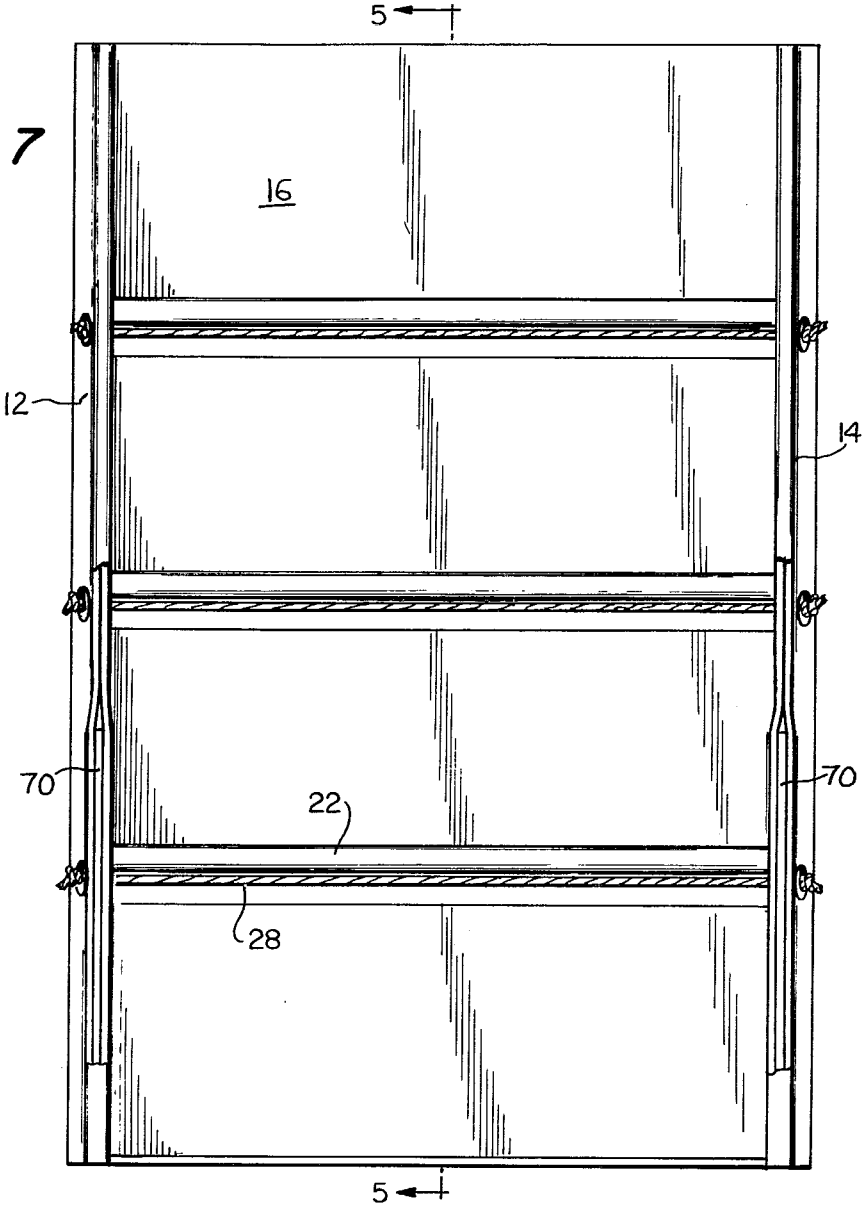
FIG. 7 is a front view of the device, partially sectioned.

When the corrugated board panel is doubled over as has been done in the construction of shelves and side walls, one or more additional pieces of corrugated board can be sandwiched inside the doubled over panel at almost any preselected locations. Any additional layer of corrugated board will, of course, serve for reinforcement purposes. Shown for example in FIG. 5 is a third corrugated board layer 60 interposed inside the folded over panels forming each of the shelves. Additional layer 60 is essentially the size of the shelves e.g. 23"×11" for shelf 18, 23"×18" for shelves 22 and 20. Shown in FIG. 7 is a partial section illustrating how a third corrugated board layer 70 may be interposed between the doubled over panel portions of side walls 12 and 14. The added corrugated board piece 70 extends to just above the level of shelf 22, e.g. 18" up.

Overall, use of a grade and weight of cardboard for display device 10 light enough to require inclusion of a third layer of reinforcement at the bottom of side walls 12, 14 is advantageous from a materials use point of view. In addition the display device of this invention employs the corrugated board with little wastage.

Mention has already been made that corrugated board is available in sheet form in standarized dimensions. Transforming the large sheet of corrugated board into panels accurately sized for side walls 12, 14, rear wall 16 and shelves 18, 20, 22 creates so little trim or waste from the large sheet the trim can be discarded. If desired, the small and odd sized pieces of corrugated board (e.g. smaller than the panel from which shelf 18 is made) which constitute the trim may be incorporated into display device 10 as the third layer reinforcement pieces described above. However, as a practical matter the reinforcement needs are too important to be satisfied by use of the trim or waste for such purposes. Indeed the reinforcement pieces 60 and 70 may well be made from a higher strength corrugated board, e.g. 275 lb. test board, than is employed to form the display device as a whole.

What is claimed:

1. A knock-down corrugated board display device comprising in erected state:

a vertically disposed rear wall;

vertically disposed side walls hingedly joined to said rear wall adjacent the side edges thereof;

a multiplicity of spaced apart shelves each hingedly joined to the rear wall, the display device being collapsible with each shelf pivoting upwardly to lie generally parallel to the rear wall and with the side walls pivoting inwardly to lie generally parallel to said rear wall sandwiching shelves between side and rear walls; and a rope positioned under each shelf from side wall to side wall and secured to each side wall, each said rope being under tension when the shelf there above is extended to a horizontal position, the tension being created by contact of the lateral side edges of the shelf immediately above said rope with the side walls, each said rope serving to support a shelf thereabove and whatever may be on the shelf.

2. The display device of claim 1 wherein each side wall has therein a keyhole slot for each rope and wherein the rope ends are knotted with a knot larger than the narrow part of the keyhole slot, each rope extending through a slot on one side wall to and through a slot on the opposing side wall, each rope being under tension through forces exerted against the side walls by the knot at the ends thereof whenever the shelf above the rope extends towards a horizontal position.

3. The display device of claim 1 wherein each side wall has a vertical bend thereon forward of the hinged juncture of side wall to rear wall a distance equal to at least the thickness of one shelf, whereby when the display device is collapsed, each side wall pivots on said bend, and that portion of the side wall rearward of said bend pivots at the hinged juncture of side wall to rear wall whereupon the panel portion rearward of said bend becomes the entire side wall of the collapsed state display device.

4. The display device of claim 3 wherein the rear wall has a forwardly bent flap at the bottom thereof, whereby when the display device is collapsed said flap becomes a bottom wall for the collapsed state display device.

5. The display device of claim 1 wherein each side wall comprises a doubled back from the front edge thereof double thickness unitary corrugated board panel whereby the front edge of each side panel is the facing material of the corrugated board.

6. The display device of claim 5 wherein a corrugated board reinforcement piece is inside the doubled back panel of each side wall, said piece extending vertically from the bottom edge of the side wall to above the lowermost shelf, thereby reinforcing the load carrying capabilities of each side wall.

7. The display device of claim 1 wherein each shelf comprises a doubled under from the front edge thereof double thickness unitary corrugated board panel, whereby the front edge of each shelf is the facing material of the corrugated board.

8. The display device of claim 7 wherein a corrugated board reinforcement piece is sandwiched inside the doubled under panel of each shelf, thereof thereby reinforcing the load carrying capability of each shelf.

9. A knock-down corrugated board display device comprising in erected state:

a vertically disposed rear wall formed from a single thickness corrugated panel;

vertically disposed forwardly extended side walls hingedly joined to the rear wall, each said side wall being formed from a unitary corrugated board panel doubled back from the front side wall edge to the inside of the display device, to a vertical terminus line located forward from said rear wall a distance at least equal to the thickness of one of the shelves hereinafter defined, whereby the front edge of each side panel is the facing material of the corrugated board;

a vertical bend in each said side wall located forward of where said side wall hingedly joins the rear wall a distance at least equal to the thickness of one of the shelves hereinafter defined, said bend being in a single thickness portion of the side wall;

a multiplicity of spaced apart shelves hingedly joined to the rear wall and extending forward therefrom between said side walls;

a rope positioned under each shelf from side wall to side wall and secured to each side wall, each said rope being under tension when the shelf immediately thereabove extends in a horizontal direction, the tension being created by contacted of the lateral side edges of the shelf with the side walls, each said rope serving to support the shelf thereabove and whatever may be on the shelf;

the display device being collapsible from erected state to knock down state, wherein upon collapse each shelf pivots upwardly to lie generally parallel to the rear wall, and the side walls pivot at each said bend and that portion of each side wall rearward of the bend thereon pivots at the hinged juncture of side wall to rear wall to make that portion of each side wall forward of the bend lie generally parallel to the rear wall sandwiching said shelves between side and rear walls, and that portion of each side wall rearward of the bend becomes the entire side wall of the knocked down display device.

10. The display device of claim 9 wherein the single thickness rear end portion of each side wall overlaps the rear face of the rear wall being joined thereto to form doubled thickness side edge portions on the rear wall, and wherein the hinged juncture of side wall to rear wall comprises a bend in the side wall closely adjacent the overlap of side edge with rear wall.

* * * * *